US005516218A

United States Patent [19]

Amano et al.

[11] Patent Number: 5,516,218

[45] Date of Patent: May 14, 1996

[54] CARD PRINTER

[75] Inventors: Toshio Amano; Hisayoshi Fujimoto, both of Kyoto, Japan

[73] Assignee: Rohm Co., Ltd., Kyoto, Japan

[21] Appl. No.: 329,972

[22] Filed: Oct. 27, 1994

[30] Foreign Application Priority Data

Oct. 29, 1993 [JP] Japan ..... 5-271399

[51] Int. Cl.[6] ..... B41J 13/12

[52] U.S. Cl. ..... 400/535; 400/521; 400/525; 400/537; 400/632

[58] Field of Search ..... 101/126, 474, 101/DIG. 36; 400/48, 521, 525, 529, 535, 536, 537, 539, 540, 630, 632, 642, 647, 120.01–120.18, 625

[56] References Cited

U.S. PATENT DOCUMENTS

| | | | |
|---|---|---|---|
| 3,240,150 | 3/1966 | Doppelt | 101/474 X |
| 4,723,133 | 2/1988 | Walter | 400/625 X |
| 5,078,522 | 1/1992 | Nishizawa | 400/630 X |
| 5,088,848 | 2/1992 | DeFalco et al. | 400/630 |
| 5,239,926 | 8/1993 | Nubson et al. | 400/635 X |
| 5,244,294 | 9/1993 | Ewing | 400/625 |
| 5,337,662 | 8/1994 | Hasegawa | 101/126 |

FOREIGN PATENT DOCUMENTS

| | | | |
|---|---|---|---|
| 389953 | of 0000 | Austria | G07B 1/00 |
| 4219682 | of 0000 | Germany | B41J 11/00 |
| 3981933 | of 0000 | Germany | B41J 11/50 |
| 3907415 | of 0000 | Germany | B41J 2/315 |
| 0114859 | 5/1991 | Japan | 400/521 |
| 0229198 | 9/1993 | Japan | 400/521 |
| 0229197 | 9/1993 | Japan | 400/521 |

OTHER PUBLICATIONS

JP Pat. Abstr. of Japan: 1–47578 A., M–832, May 30, 1989, vo. 13, No. 234; 4–239672 A., M–1350, Jan. 7, 1993, vol. 17, No. 8.

JP Patent Abstracts of Japan: 5–155446 A., M–1492, Oct. 6, 1993, vol. 17, No. 555.

*Primary Examiner*—Christopher A. Bennett
*Attorney, Agent, or Firm*—Michael D. Bednarek

[57] ABSTRACT

A card printer is provided which comprises a printhead, a carrier table reciprocatively movable along a movable path in facing relation to the printhead, a drive mechanism for reciprocating the carrier table, a card transfer mechanism for successively feeding each of cards onto the carrier table, and a positioning assembly for appropriately positioning the card on the carrier table. The positioning assembly comprises a pair of stopper pins which is retractably projectable from the carrier table for stopping engagement with the leading edge of the card, and a cam mechanism for causing the stopper pins to project from the carrier table when the carrier table assumes a standby position for receiving the card.

16 Claims, 11 Drawing Sheets

CARD PRINTER

BACKGROUND OF THE INVENTION

1. Field of the Invention

The present invention relates to a printer for suitably impressing a print, particularly a color print, on a card which is made of a plastic material for example.

2. Description of the Related Arts

As is well known, cards are widely used for various purposes in our lives. Examples include personal identification cards (ID cards), credit cards, security cards, members cards, bank cards, and etc. Due to such prevailing of cards, there is an increasing demand for conveniently impressing a color print on the card.

The color printing is most commonly performed by an overprinting method wherein different prints in different colors are formed one on another according to the image data. According to the so-called Y.M.C. printing method, for example, a printhead is caused to successively impress a yellow print (Y: Yellow), a red print (M: Magenta), and a blue print (C: Cyanine) in overlapping relation onto a plastic card. In the so-called Y.M.C. B. printing method, a black print is additionally formed over the Y.M.C. prints.

Conventional color printers are exclusively designed for impressing an identical color print on a great number of cards. Therefore, the conventional printers are usually large-sized and structurally complicated in addition to being relatively expensive. Thus, the conventional printers are not suitable for impressing different color prints on a small lot basis. Further, the conventional printers usually incorporate a large number of solenoids and motors together with a controller for enabling sophisticated printing, which fact also adds to the size and cost of the printer.

SUMMARY OF THE INVENTION

It is, therefore, an object of the present invention to provide a card printer which is adapted for impressing different kinds of prints, particularly color prints, onto different cards on a small lot basis.

More specifically, the present invention seeks to provide a card printer which, while being relatively simple in construction and relatively inexpensive, is capable of accurately positioning a card and reliably impressing an intended print thereon.

The present invention also seeks to provide a card printer which is capable of impressing a print substantially over the entire surface of a card.

The present invention further seeks to provide a card printer which is capable of preventing erroneously feeding two cards at a time.

According to the present invention, there is provided a card printer comprising: a printhead; a carrier table reciprocatively movable along a movable path in facing relation to the printhead; a drive mechanism for reciprocating the carrier table; a card transfer mechanism for successively feeding each of the cards onto the carrier table, said each card having a leading edge and a trailing edge; and positioning means for appropriately positioning said each card on the carrier table; wherein the positioning means comprises stopper means which is retractably projectable from the carrier table for stopping engagement with the leading edge of said each card, and a cam mechanism for causing the stopper means to project from the carrier table when the carrier table assumes a standby position for receiving said each card.

With the arrangement described above, the stopper means works to accurately position said each card on the carrier table, so that the printhead can reliably impress an intended print onto said each card. In this regard, since the stopper means is actuated mechanically by the cam mechanism, it is unnecessary to provide electric components (such as solenoid, motor, controller, and etc.) for operating the stopper means. Thus, the card printer can be made to have a relatively simple and inexpensive structure.

Typically, the stopper means may comprise a pair of stopper pins. Further, the cam mechanism may comprise a follower plunger connected to each of the stopper pins and spring-biased in a retracting direction, and a cam track member for camming contact with the follower plunger.

According to a preferred embodiment of the present invention, the positioning means further comprises front pressing roller means positioned ahead of the printhead for movement toward and away from the carrier table, rear pressing roller means positioned behind the printhead for movement toward and away from the carrier table but spaced from the front pressing roller means by a distance which is smaller than a length of said each card, and spring means for bringing each of the front and rear pressing roller means into pressing contact with said each card. Further, the carrier table is provided with front lifting means for lifting the front pressing roller means away from the carrier table when the front pressing roller means rides over the leading edge of said each card, and rear lifting means for lifting the rear pressing roller means away from the carrier table when the rear pressing roller means rides over the trailing edge of said each card. Such an arrangement enables the printhead to impress a print over the entire surface of said each card.

The cards may be stored as a stack within a card stocker. In this case, the card transfer mechanism may preferably comprise returning means for returning, to the card stocker, a card erroneously fed with said each card while allowing said each card to advance to the carrier table.

The printhead may be rendered movable toward and away from the carrier table by means of a lifting mechanism. The movability of the printhead ensures smooth feeding of said each card onto the carrier table, smooth reciprocation of the carrier table, and smooth feeding of an ink ribbon.

Further, it is also convenient if the card printer additionally comprises a discharge mechanism for discharging said each card from the carrier table when the carrier table advances to a predetermined discharge position. Specifically, the discharge mechanism comprises a pivotal lever carrying an engaging member and supported to pivot between an operative position and a non-operative position. The engaging member has a hooked tip end for engagement with the trailing edge of said each card when the lever is pivoted to the operative position after the carrier table advances to the discharge position.

Preferably, the discharge mechanism may further comprise pusher means carried by the carrier table and cooperating with the cam mechanism for pushing up the trailing edge of said each card when the carrier table advance to the discharge position. Apparently, the pusher means faciliates removal of said each card from the carrier table.

Other objects, features and advantages of the present invention will become clear from the following description of preferred embodiment made with reference to the attached drawings.

DETAILED DESCRIPTION OF THE PREFERRED EMBODIMENT

Figure 1:
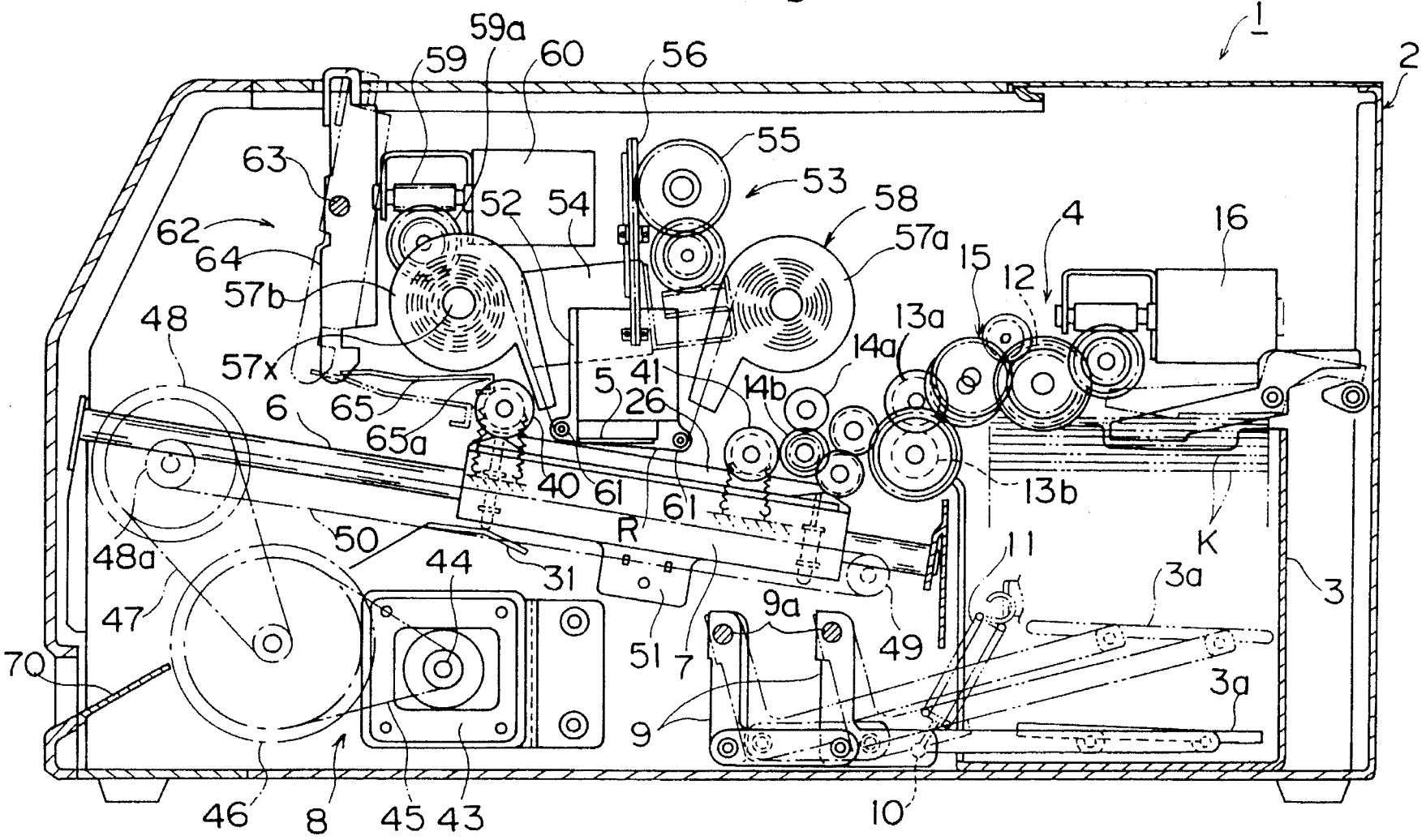
FIG. 1 is a side view, in vertical section, showing a card printer embodying the present invention.
Figure 2:
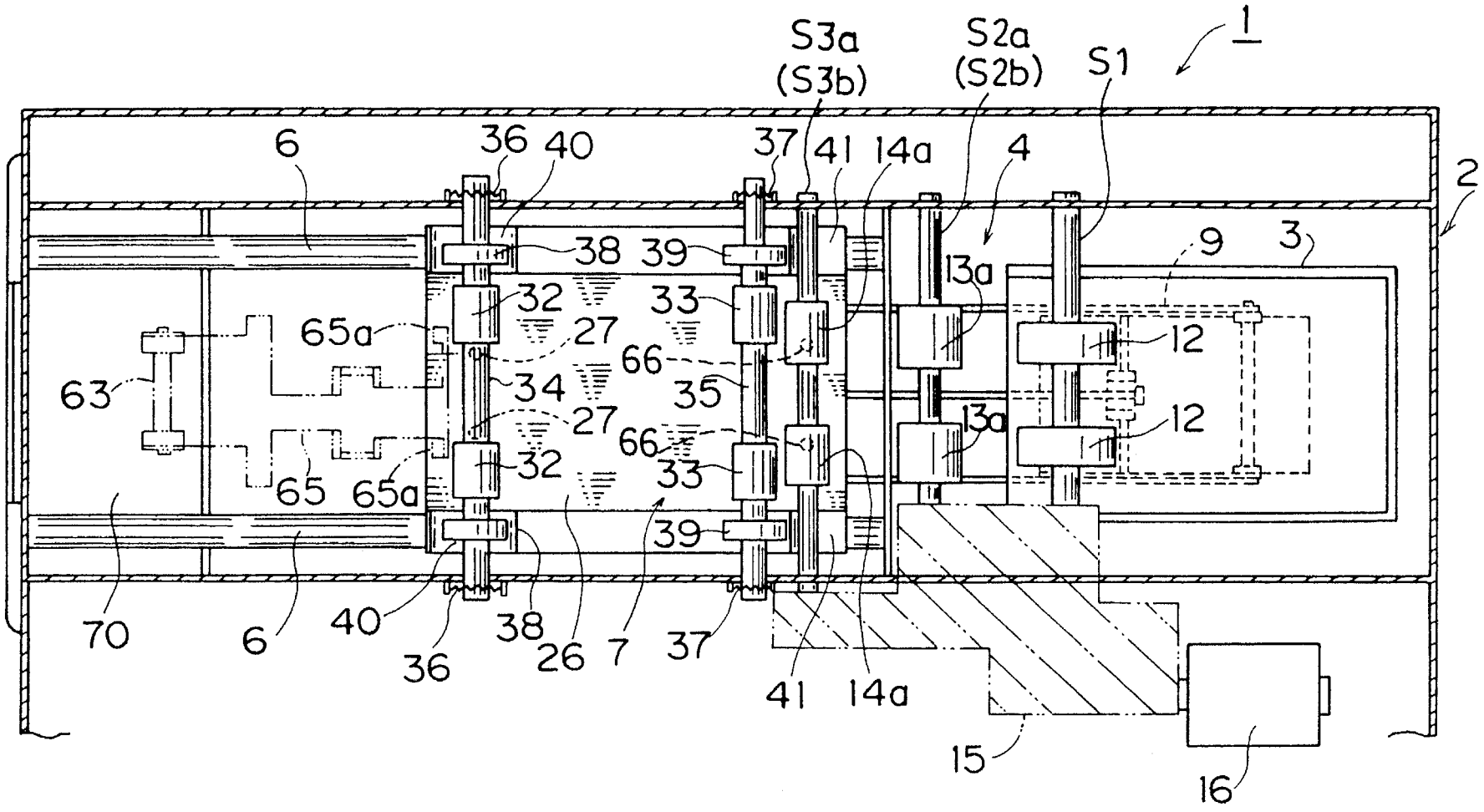
FIG. 2 is a plan view, in horizontal section, showing the same printer.

Referring first to FIGS. 1 and 2, there is shown the entirety of a card printer generally represented by reference numeral 1. The printer 1 comprises a housing 2 which accommodates an upwardly open box-like card stocker 3 for receiving a stack of cards K, a card transfer mechanism 4 associated with the card stocker 3 for supplying the cards K one after another, and a printhead 5 for printing on each of the successively supplied cards K, a carrier table 7 reciprocally movable along a pair of guide rods 6 below the printhead 5, and a drive mechanism 8 for reciprocating the carrier table 7. Each of the guide rods 6 is slightly inclined forwardly upward.

The card stocker 3 is provided therein with a liftable support plate 3*a* for placing the stack of cards K. Each side edge of the support plate 3*a* is hinged to a pair of L-shaped links 9 which are parallel to each other and pivotable about respective pivot shafts 9*a*. The pair of links 9 form a parallelogram linkage mechanism together with the support plate 3*a*. One of the links 9 is connected to one end 10 of a tension coil spring 11. The other end of the tension spring 11 is connected to a fixed member (only partially shown in FIG. 1). Thus, the support plate 3*a* is always biased upward by the tension spring 11, so that the position of the support plate 3*a* rises progressively as the cards K are successively supplied.

Figure 3:
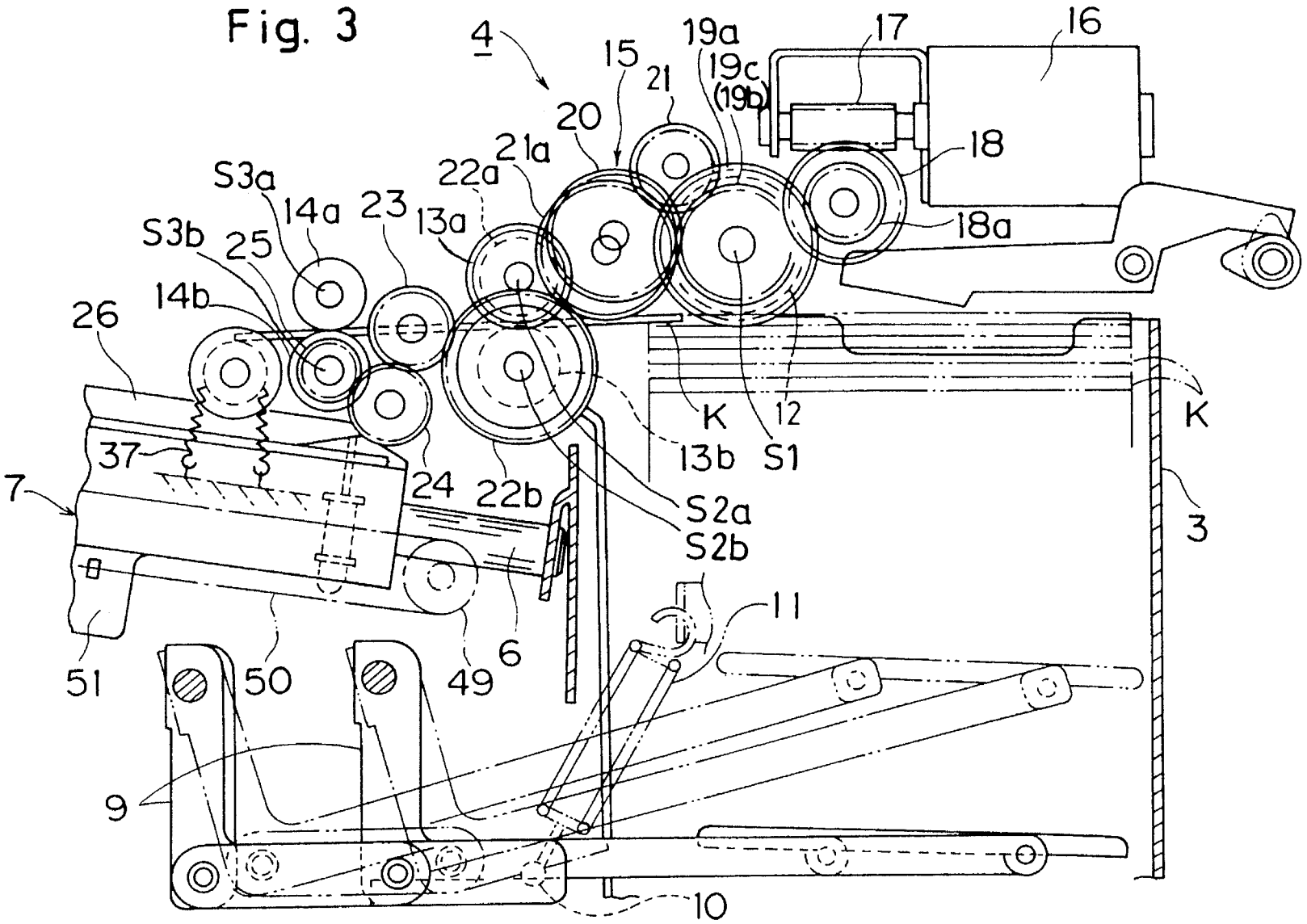
FIG. 3 is an enlarged fragmentary side view, in vertical section, showing a card transfer mechanism of the same printer together with a card stocker.

As shown in FIGS. 2 and 3, the card transfer mechanism 4 includes a pair of entry feed rollers 12 mounted on a first shaft S1, two pairs of intermediate feed rollers 13*a*, 13*b* mounted on a pair of second shafts S2*a*, S2*b*, and two pairs of exit feed rollers 14*a*, 14*b* mounted on a pair of third shafts S3*a*, S3*b*. Each entry feed roller 12 comes into pressing contact with the uppermost card K under the biasing force of the tension coil spring 11 for frictionally feeding the uppermost card forward. Each pair of intermediate feed rollers 13*a*, 13*b* receives the card therebetween from the entry roller 12 and further advances it. Each pair of exit feed rollers 12*a* receives the card therebetween from the pair of intermediate feed rollers 13*a*, 13*b* for supplying it onto the carrier table 7.

Figure 4:
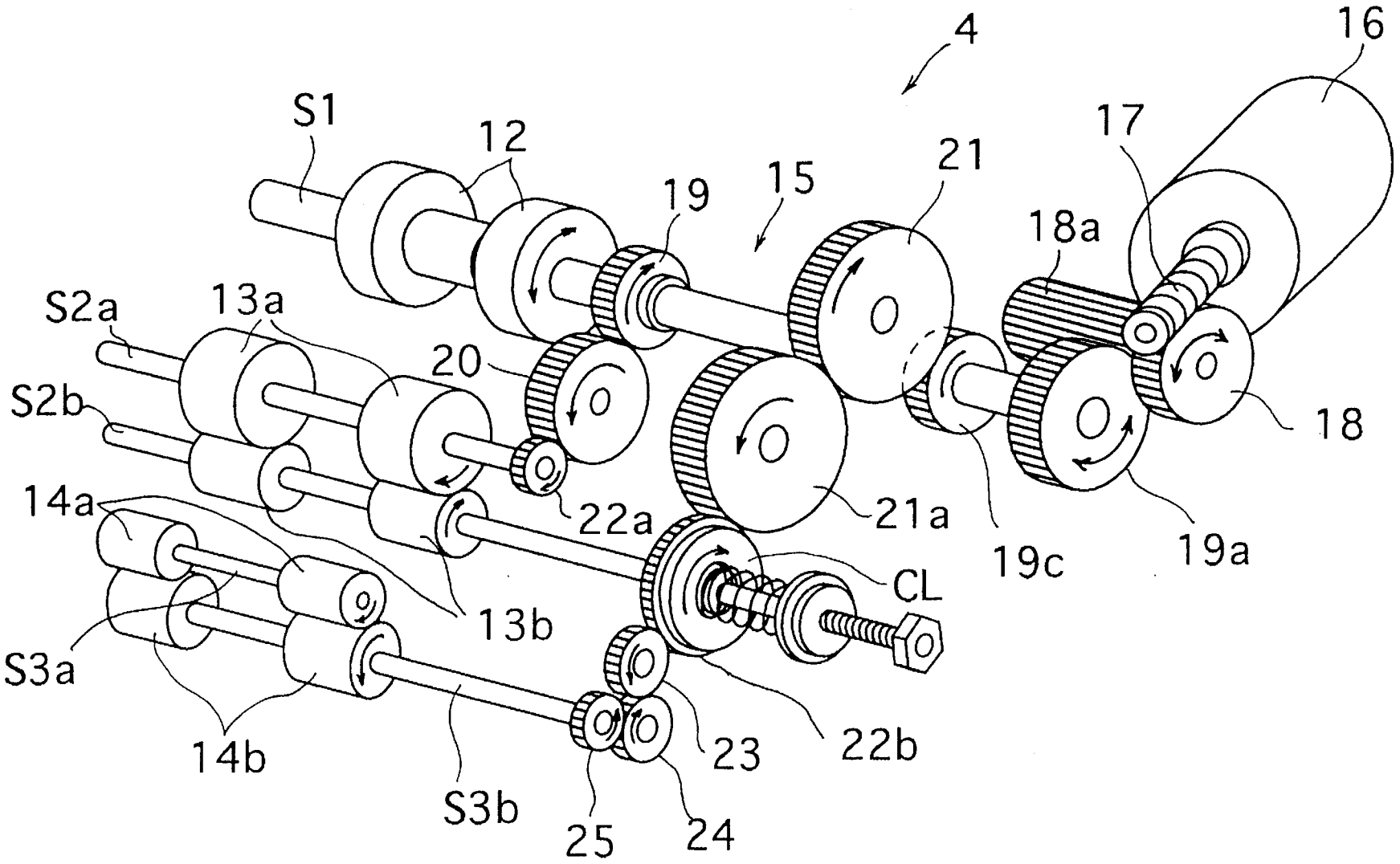
FIG. 4 is a perspective view showing the card transfer mechanism.

The card transfer mechanism 4 further includes a transmission gear assembly 15 driven by a reversible motor 16. As shown in FIGS. 3 and 4, the transmission gear assembly 15 comprises a worm 17 mounted on the output shaft of the motor 16, a worm wheel 18 held in mesh with the worm 17, a first gear 18*a* integrally rotatable with the worm wheel 18, a second gear 19*a* mounted on the first shaft S1 in mesh with the first gear 18*a*, a third gear 19*b* mounted on the first shaft S1, and a fourth gear 19*c* mounted on the same first shaft S1. The third gear 19*b* is held in mesh with a fifth gear (idle gear) 20 which is in turn held in mesh with a sixth gear 22*a* mounted on the upper one S2*a* of the second shafts. The fourth gear 19*c* is drivingly connected, through seventh and eighth gears (idle gears) 21, 21*a*, to a ninth gear 22*b* which is mounted on the lower one S2*b* of the second shafts. Further, the ninth gear 22*b* is drivingly connected, through tenth and eleventh gears (idle gears) 23, 24, to a twelfth gear 25 mounted on the lower one S3*b* of the third shafts.

Of the various gears described above, the third gear 19*b* on the first shaft S1 is a one-way clutch gear which locks on and rotates with the first shaft S1 only in the forward rotational direction. Thus, due to the intervention of the single idle gear (fifth gear) 20, the upper ones 13*a* of the intermediate feed roller pairs rotate in the forward direction together with the sixth gear 22*a* for feeding the card K forward only when the reversible motor 16 rotates in the forward direction. It should be appreciated that the entry feed rollers 12 which are directly mounted on the first shaft S1 can rotate both in the forward and reverse directions depending on the rotational direction of the motor 16.

On the other hand, the fourth gear 19*c* on the same first shaft S1 is also a one-way clutch gear which, unlike the third gear 19*b*, locks on and rotates with the first shaft S1 only in the reverse rotational direction. Thus, due to the intervention of the two idle gears (seventh and eighth gears) 21, 21*a*, the lower ones 13*b* of the intermediate feed roller pairs rotate in the backward direction together with the ninth gear 22*b* only when the reversible motor 16 rotates in the reverse direction. However, due to the intervention of the two further idle gears (tenth and eleventh gears) 23, 24, the lower ones 14*b* of the exit feed roller pairs rotate in the forward direction together with the twelfth gear 25 even if the motor 16 rotates in the reverse direction. The reason for backwardly rotating the lower intermediate feed rollers 13*b* will be described hereinafter.

As clearly illustrated in FIG. 4, the ninth gear 22*b* is not fixed on the lower second shaft S2*b* but instead provided with a spring-biased friction clutch CL. Thus, the ninth gear 22*b* can transmit its torque to the lower second shaft S2*b* (namely, the lower ones 13*b* of the intermediate roller pairs) only up to a predetermined level but rotates idly by sliding relative to the friction clutch CL beyond the predetermined level. The technical significance of such an arrangement will be described later.

Though not specifically shown, the transmission gear assembly 15 may further comprises a train of gears which causes the lower exit feed rollers 14*b* to rotate forwardly only when the motor 16 is rotated forwardly. Such a gear train includes an additional one-way clutch gear which is mounted on the first shaft S1 and locks thereto only in the forward rotational direction like the third gear 19*b*. In this case, the lower exit feed rollers 14*b* rotate forwardly from the very beginning of the card transferring operation.

Figure 5:
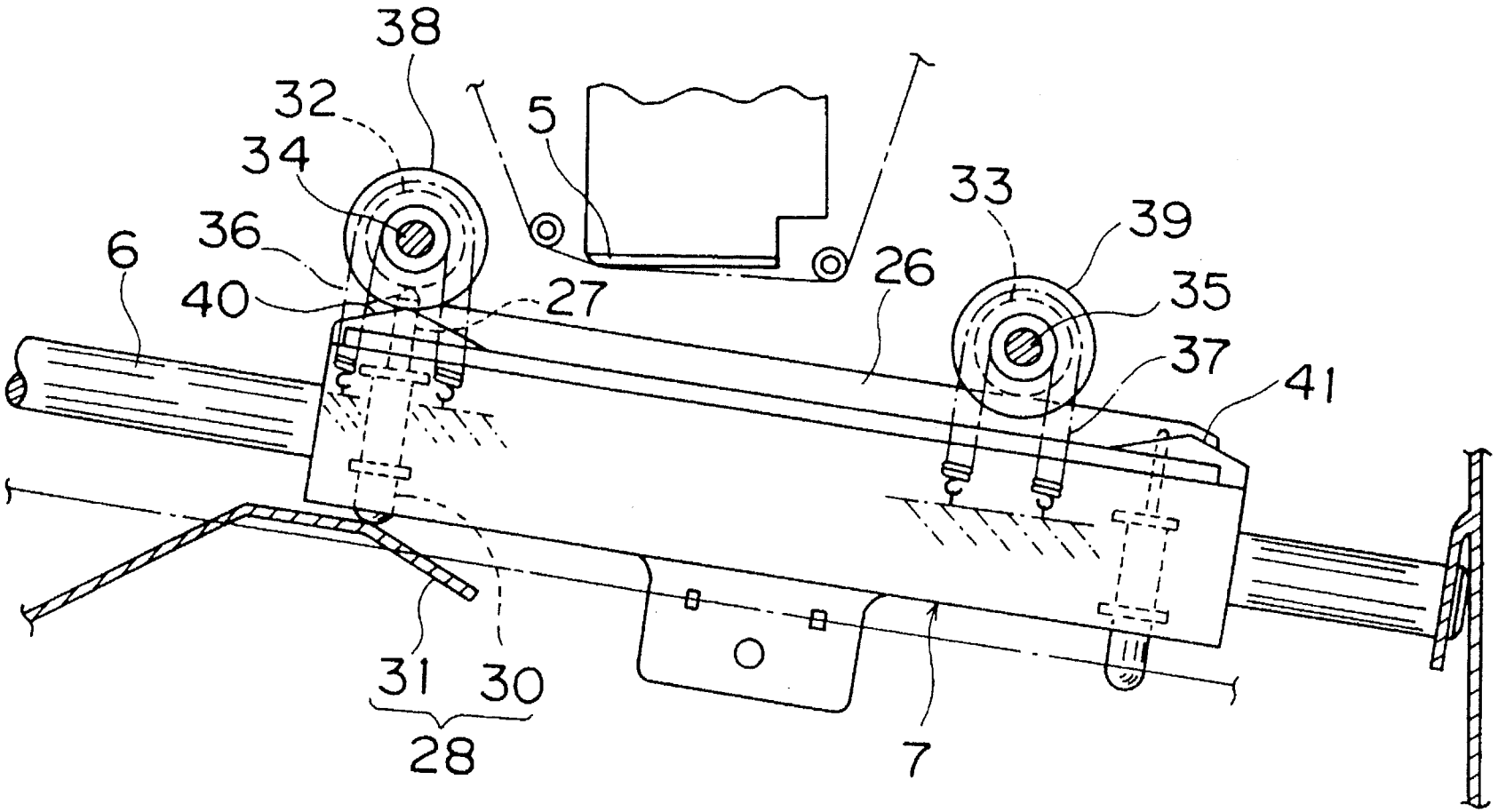
FIG. 5 is an enlarged fragmentary side view showing a carrier table of the same printer together with a printhead.
Figure 6:
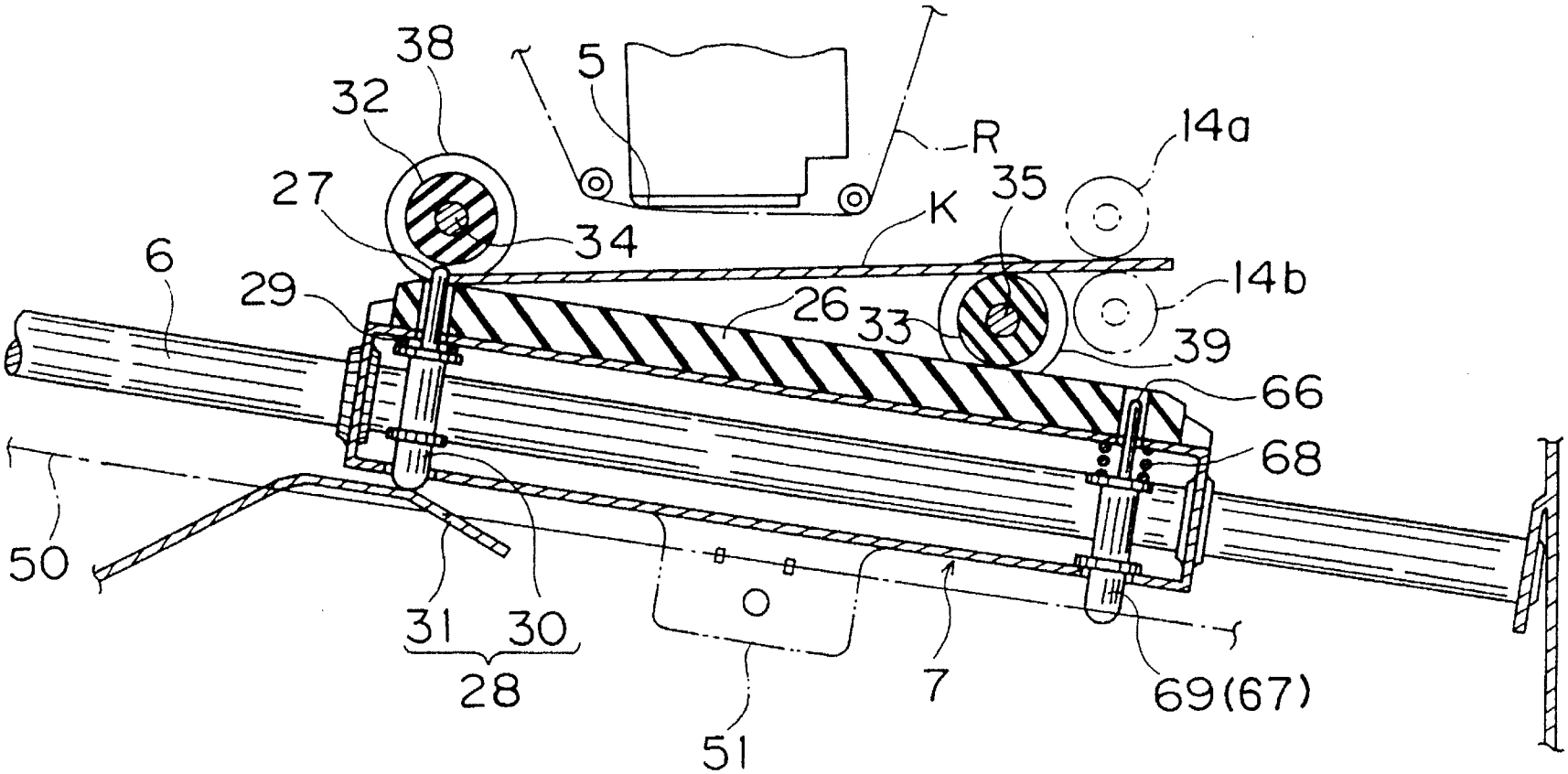
FIGS. 6–11 are side views, in vertical section, showing how the card printer operates.

As shown in FIGS. 5 and 6, the carrier table 7 has an upper surface provided with a flat surface member 26 which may be made of rubber or resin for example. The carrier table 7 is further provided, adjacent its leading edge, with two stopper pins 27 (see also FIG. 2) which are spaced from each other widthwise of the carrier table 7 and adapted to retractably project from the surface member 26.

The movement of each stopper pin 27 is controlled by a cam mechanism 28 which comprises a follower plunger 30 integrally extending downwardly from the pin 27 through the carrier table 7 and urged downwardly by a spring 29. The cam mechanism 28 also comprises a cam track member 31 arranged under the follower plunger 30 for cooperation therewith. The cam track member 31 is fixed to the housing 2 (see FIG. 1). It should be understood that the cam mechanism 28 is not limited to the illustrated example but may be replaced by another which is capable of moving the stopper pin 27 in a predetermined manner.

As shown in FIGS. 1, 2 and 5, a pair of front pressing rollers 32 made of e.g. rubber or resin is arranged above the carrier table 7 as mounted on a fourth shaft 34. Similarly, a pair of rear pressing rollers 33 made of e.g. rubber or resin is arranged above the carrier table 7 as mounted on a fifth shaft 35.

The fourth and fifth shafts 34, 35 are rotatably and vertically movably supported by the housing 2 while being always urged downward by respective springs 36, 37. Thus, the front and rear pressing rollers 32, 33 are held pressed against the surface member 26 of the carrier table 7.

As appreciated from FIG. 5, the pair of front pressing rollers 32 is spaced from the pair of rear pressing rollers 33 by a distance which is smaller than the length of the card K. As a result, at least either pair of front or rear rollers 32, 33 pressingly retains the card K throughout the printing operation.

As shown in FIG. 2, the pair of front pressing rollers 32 is flanked by a pair of front guide rollers 38 mounted on the fourth shaft 34, whereas the carrier table 7 is provided with a pair of front lifting wings 40 for lifting the front pressing rollers 32 away from the carrier table 7 against the corresponding springs 36 when the front guide rollers 38 ride on the front wings 40. Similarly, the pair of rear pressing rollers 33 is flanked by a pair of rear guide rollers 39 mounted on the fifth shaft 35, whereas the carrier table 7 is provided with a pair of rear lifting wings 41 for lifting the rear pressing rollers 33 away from the carrier table 7 against the corresponding springs 37 when the rear guide rollers 39 ride on the front wings 41.

Returning to FIG. 1, the drive mechanism 8 for reciprocating the carrier table 7 comprises a stepping motor 43 fixed to the housing 2, a drive wheel 44 such as a sprocket or pulley mounted on the output shaft of the stepping motor 43, an intermediate double wheel 46 connected to the drive wheel 44 via an endless transmission loop 45 such as a timing belt or chain, and a driven double wheel 48 connected to the intermediate double wheel 46 via another endless transmission loop 47. The driven double wheel 48 has a diametrically small portion 48*a* connected to an auxiliary driven wheel 49 via an endless driven loop 50. The carrier table 7 has a downward bracket 51 which is fixed to a suitable portion of the driven loop 50.

As also shown in FIG. 1, the printhead 5 is carried by a mounter 52 which is vertically movable toward and away from the carrier table 7 by a lifting mechanism 53. Specifically, the lifting mechanism 53 includes a motor 52 for driving a pinion 55 via a suitable transmission gear assembly (such as a combination of a worm and a worm wheel), and a rack 56 held in mesh with the pinion 55 and connected to the printhead mounter 52. Of course, the lifting mechanism 53 may be replaced by any other mechanism (such as a solenoid drive mechanism or a belt drive mechanism) which is capable of vertically moving the printhead mounter 52.

The printhead 5 is associated with a ribbon cartridge 58 which includes a ribbon supplying case 57*a* behind the printhead 5 and a ribbon winding case 57*b* ahead of the printhead 5. The ribbon winding case 57*b* has a drive shaft 57*x* which is rotated by a motor 60 via a worm 59 and a worm wheel 59*a* for winding up the ribbon R from the ribbon supplying case 57*a*. Further, the printhead mounter 52 is provided with ribbon guide rollers 61 for guiding the ribbon R in facing relation to the printhead 5 which has been lowered for printing.

At an upper front portion of the housing 2, there is provided a discharge mechanism 62 which comprises a lever 64 pivotally supported on a pivot shaft 63, as shown in FIG. 1. The lever 64 carries, at its lower end, an engaging member 65 extending rearwardly and having a hooked tip end 65 for engagement with the trailing edge of the card K which has already undergone an printing operation (see FIGS. 10 and 11). Though not specifically illustrated, the discharge mechanism 62 is operated by an actuating mechanism for pivoting the lever 64 in timed relation to the movement of the carrier table 7.

Figure 10:
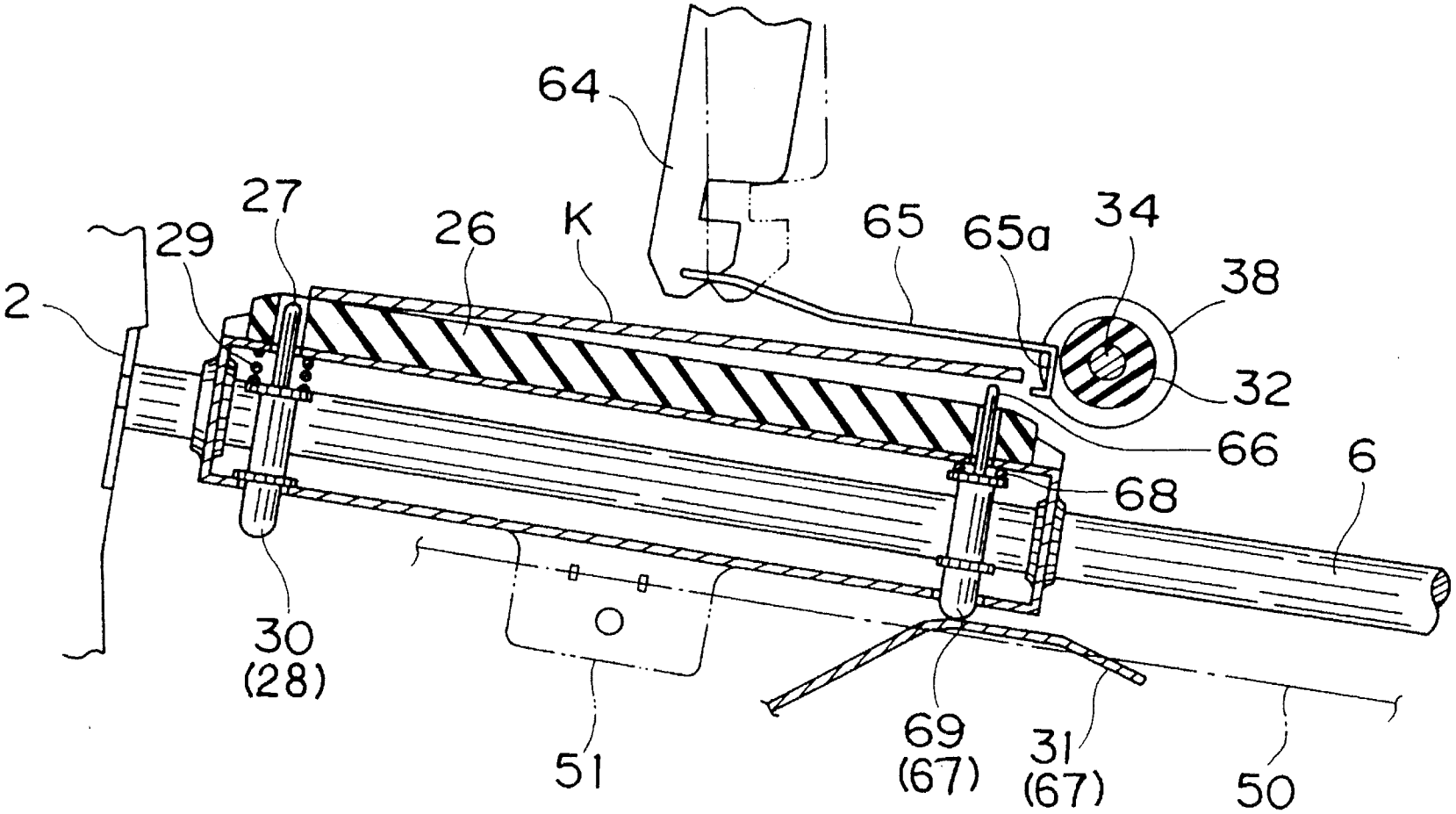

As shown in FIGS. 2 and 10, the carrier table 7 is provided, adjacent its trailing edge, with two pusher pins 66 which are spaced from each other widthwise of the carrier table 7 and adapted to retractably project from the surface member 26. The movement of each pusher pin 66 is controlled by a cam mechanism 67 (see FIG. 10) which comprises a follower plunger 69 integrally extending downwardly from the pusher pin 66 through the carrier table 7 and urged downwardly by a spring 68. Another component of the cam mechanism 67 is provided by the cam track member 31 which is already described in connection with the cam mechanism 28 for each stopper pin 27.

As shown in FIG. 1, a lower front portion of the housing 2 is provided with a discharge chute 70 for discharging the cark K which has been removed from the carrier table 7.

The card printer 1 having the above-described structure operartes in the following manner.

Initially, as shown in FIGS. 3 and 5, the carrier table 7 assumes its standby position (standard position), and the printhead 5 assumes its raised position. Further, the card stocker 3 contains a stack of cards K as urged upward against the entry feed rollers 12 by the spring 11.

In this condition, the motor 16 is first rotated forwardly with the pair of entry feed rollers 12 held in contact with the uppermost card K in the card stocker 3. The forward rotation of the motor 16 causes the upper rollers 13*a* of the intermediate feed roller pairs to rotate forwardly by torque tranmission in the order of the worm 17, worm wheel 18, first gear 18*a*, second gear 19*a*, third gear 19*b* (which locks only at the time of forwardly rotating the motor 16), fifth gear 10 and sixth gear 22*a* (see also FIG. 4). Further, the forward rotation of the motor 16 also causes the entry feed rollers 12 to rotate forwardly. As a result, the uppermost card K is frictionally advanced by the entry feed rollers 12 and then passes through the pairs of intermediate feed rollers 13*a*, 13*b*.

When the uppermost card K advances to a predetermined detection point provided by an unillustrated optical sensor (e.g. phototransistor), an unillustrated timer actuates to start time counting. Upon lapse of a predetermined time, the motor 16 is reversed. The predetermined time for switching to the reverse rotation of the motor 16 is set to make sure that the leading edge of the uppermost card K slightly passes through the pairs of exit feed rollers 14*a*, 14*b*, whereas the trailing edge of the uppermost card K completely leaves the entry feed rollers 12, as also shown in FIG. 3.

The reverse rotation of the motor 16 causes the lower rollers 14*b* of the exit feed roller pairs to rotate forwardly by torque transmission in the order of the worm 17, worm wheel 18, first gear 18*a*, second gear 19*a*, fourth gear 19*c* (which locks only at the time of reversely rotating the motor 16), seventh gear 21, eighth gear 21*a*, ninth gear 22*b*, tenth gear 23, eleventh gear 24 and twelfth gear 25 (see FIG. 4). As a result, the uppermost card K is advanced further by the forward rotation of the lower rollers 14*b* of the exit feed roller pairs.

On the other hand, the reverse rotation of the motor 16 tends to backwardly rotate the lower rollers 13*b* of the intermediate feed roller pairs by torque transmission in the order of the worm 17, worm wheel 18, first gear 18*a*, second gear 19*a*, fourth gear 19*c*, seventh gear 21, eighth gear 21*a*, ninth gear 22*b* and friction clutch CL (see FIG. 4). However, since the friction clutch CL can slide relative to the ninth gear 22*b*, the backward torque applied to the uppermost card K by the lower intermediate feed rollers 13*b* is overcome by the forward pull applied to the same card K by the lower exit feed rollers 14*b*. Thus, the uppermost card K still continues to move forward by the action of the lower exit feed rollers 14*b*.

It is possible, though, that the uppermost card K is unexpectedly followed by another card immediately below due to friction and/or static electricity. In such an event, the lower intermediate feed rollers 13*b* tending to rotate backwardly functions to return the lower accompanying card which has been erroneously advanced. Further, the entry feed rollers 12, which are now rotating backward due to the reverse rotation of the motor 16, also work to return the erroneously advanced card completely back into the card stocker 3.

In this way, the transfer mechanism 4 is capable of selectively advancing the uppermost card K alone by first rotating the motor 16 forwardly and then reversing the motor rotation.

During the above-described transfer of the uppermost card K, the carrier table 7 stays in its standby position, as shown in FIG. 6. In this position, each stopper pin 27 projects above the surface member 26 with the plunger 30 raised by the cam track member 31, whereas the front pressing rollers 32 are raised away from the surface member 26 with the front guide rollers 38 riding on the respective front lifting wings 40 (see FIG. 2). Therefore, the leading edge of the advancing card K comes into contact with the stopper pin 27 under the raised front pressing rollers 32.

Figure 7:
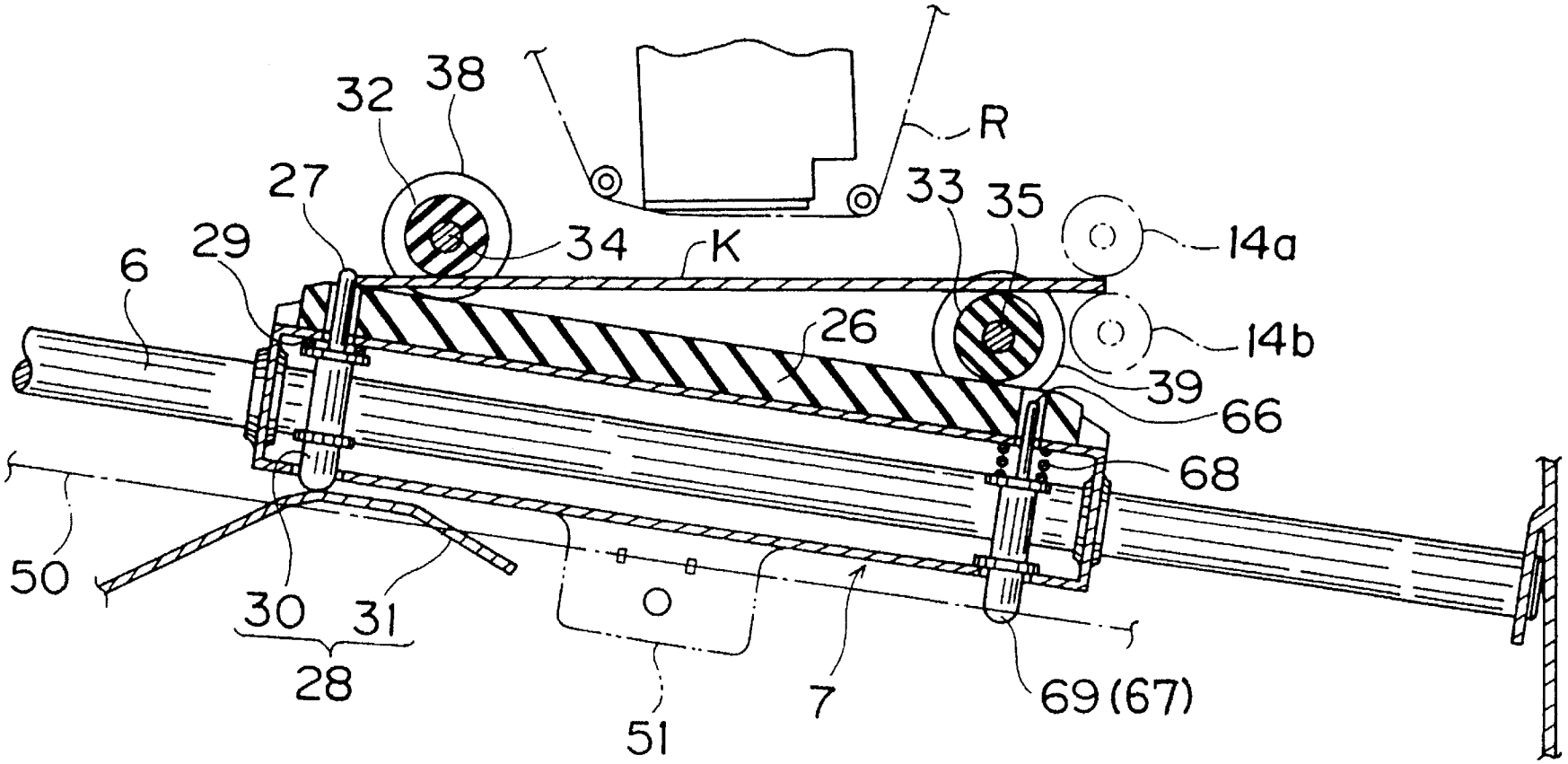

When the leading edge of the card K comes into contact with the projecting stopper pin 27 (as confirmed by optical detection for example), the motor 43 for the drive mechanism 8 (see FIG. 1) is actuated to advance the carrier table 7. As shown in FIG. 7, the stopper pin 27 stays in its projecting state at least until the trailing edge of the card K completely passes through the pairs of exit feed rollers 14*a*, 14*b*. The motor 16 for the card transfer mechanism 4 (see FIG. 1) is stopped when the unillustrated timer (previously described) has counted another predetermined time which is required for the card K to pass completely through the pairs of exit feed rollers 14*a*, 14*b*.

Figure 8:
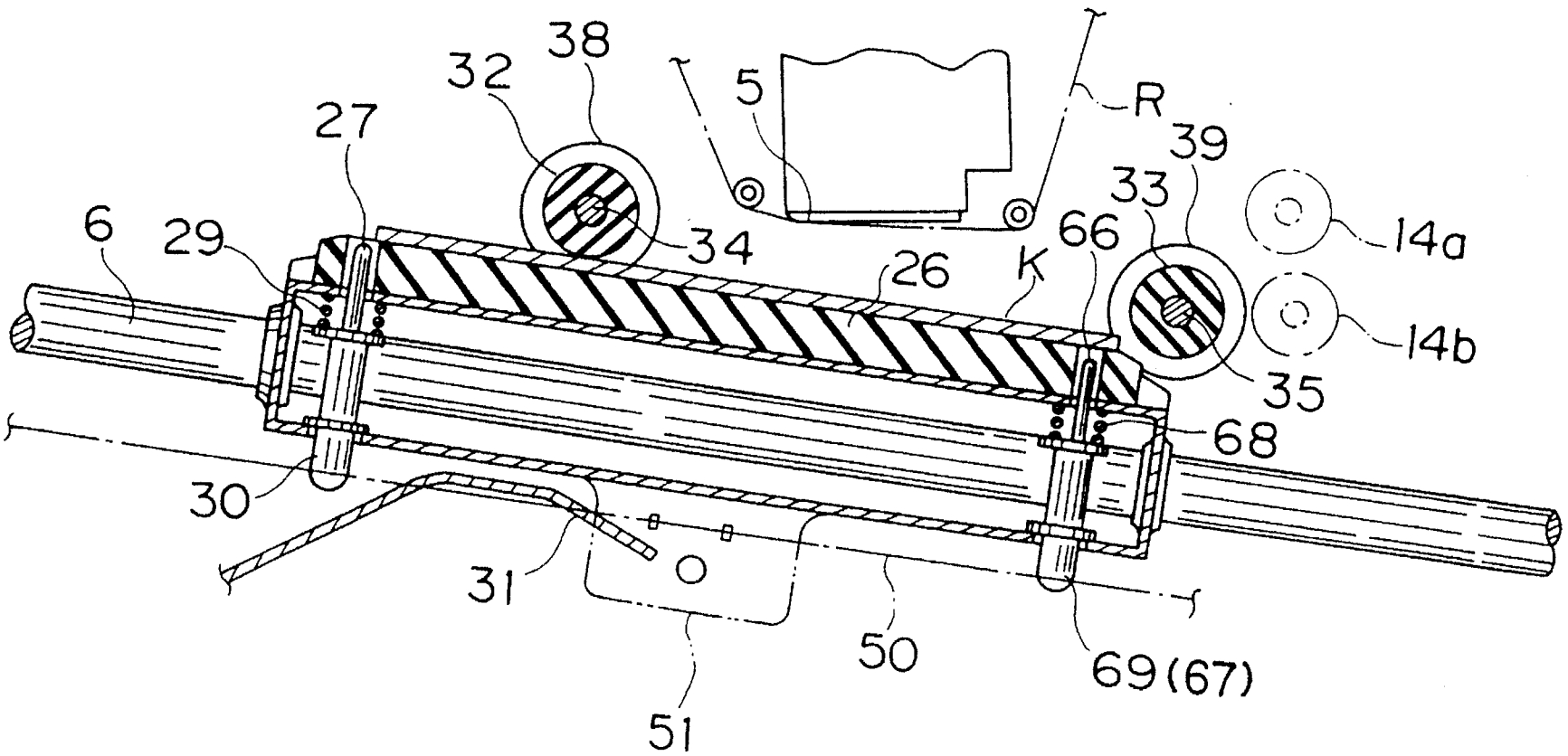

Upon further advance of the carrier table 7, the follower plunger 30 comes out of engagement with the cam track member 31 to allow retreating movement of the stopper pin 27, whereas the front guide rollers 38 disengage from the front lifting wings 40 (see FIG. 2) to bring the front pressing rollers 32 into pressing contact with the card K, as shown in FIG. 8. Thus, the card K is retained in its proper printing position on the surface member 26 of the carrier table 7 by the front pressing rollers 32. At this time, the trailing edge of the card K has completely passed over the rear pressing rollers 33, so that the entirety of the card K can thus be placed on the surface member 26.

Then, the motor 43 for the drive mechanism 8 (see FIG. 1) is reversed to move the carrier table 7 backward. As a result, the rear pressing rollers 33 come into pressing contact with the card K, thereby retaining the card K in its proper printing position on the surface member 26 of the carrier table 7.

Figure 9:
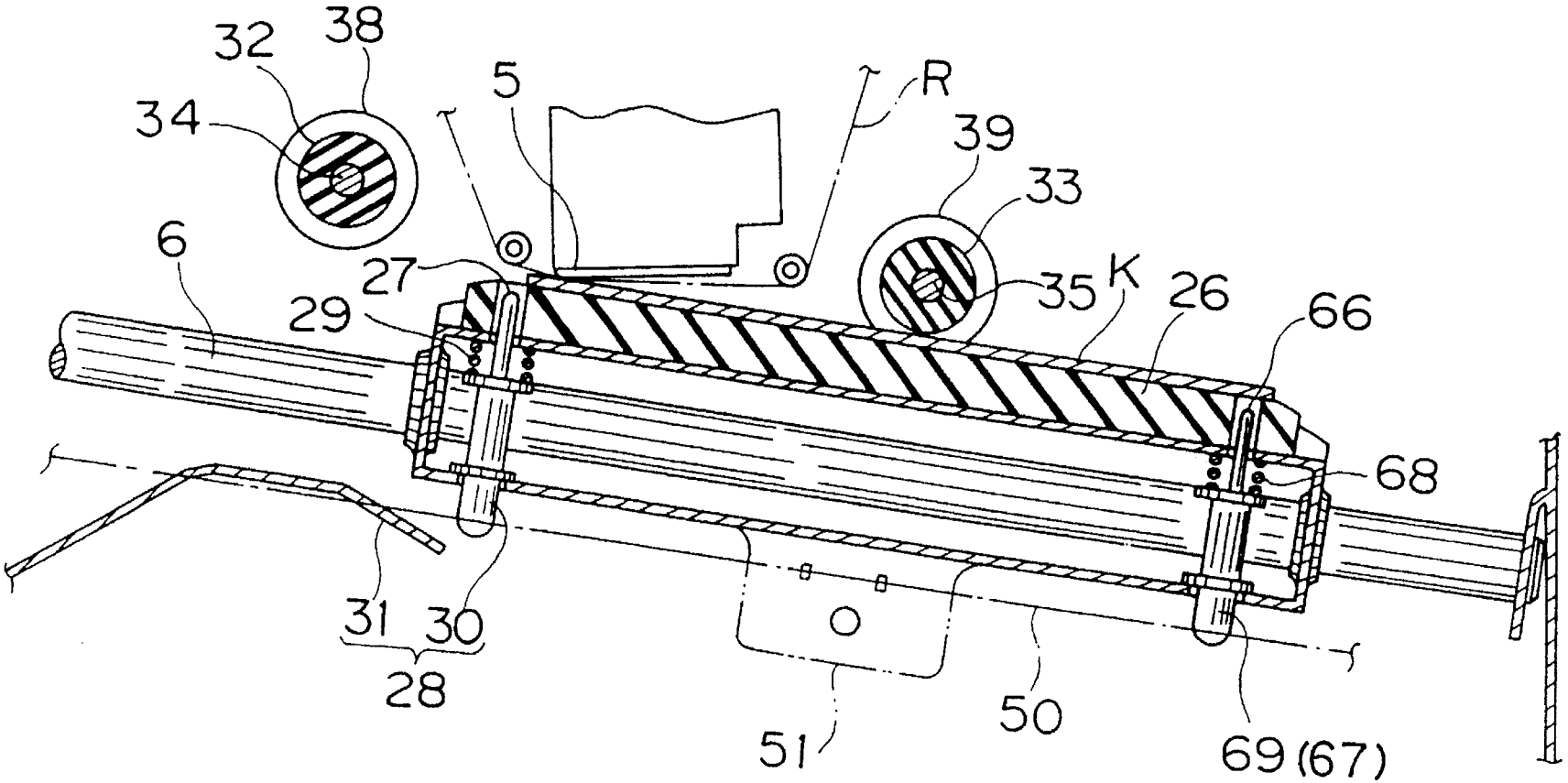

When the carrier table 7 moves backward to the position of FIG. 9 (which is the printing start position), the printhead 5 is lowered to bring the ink ribbon R into contact with the card K by actuating the motor 54 for the lifting mechanism 53 (see FIG. 1). For color printing, the ink ribbon R may carry longitudinally repetitive groups of longitudinally alternate layers. Specifically, each group of longitudinally alternate layers include a yellow ink layer, a red ink layer, a blue ink layer and an overprotect layer. The overprotect layer is followed by a black distinction line which is in turn followed by the yellow ink layer of the next group. For starting the color printing operation, therefore, the motor 60 (see FIG. 1) for the ribbon cartridge 58 must be stopped when the black distinction line is optically detected.

In this condition, the motor 43 for the drive mechanism 8 is rotated again in the forward direction for advancing the carrier table 7, thereby allowing the printhead 5 to first impress a yellow color print onto the card K in accordance with the image data or signals supplied to the printhead 5. At the beginning of the advancing stroke for the printing operation, the rear pressing rollers 33 are held in pressing contact with the card K for positional retention thereof. Thus, it is possible to start the printing substantially from the leading edge of the card K.

Toward the end of the advancing stroke for the printing operation, on the other hand, the front pressing rollers 32 come into pressing contact with the card K for positional retention thereof (see FIG. 8 for example). Thus, it is possible to perform the printing substantially up to the trailing edge of the card K.

In this way, at least either the front or rear pressing rollers 32, 33 are held in pressing contact with the card K on the surface member 26 during the printing operation. Thus, the printing may be performed substantially over the entire length of the card K.

After finishing the yellow color printing, the printhead 5 is lifted away from the carrier table 7, and the motor 60 (see FIG. 1) for the ribbon cartridge 58 is driven to wind the ink ribbon R until the red ink layer of the same group faces the printhead 5.

In the meantime, the carrier table 7 is returned again to the printing start position of FIG. 9, and the printhead 5 is lowered again to bring the ink ribbon R into contact with the card K.

By repeating the same operation as is done for the yellow color printing, the card K is subjected to red color printing, blue color printing and final overprotect layer formation.

During the repetitive reciprocation of the carrier table 7 for the color printing, the front pressing rollers 32 need to ride over the leading edge of the card K, where the rear pressing rollers 33 must ride over the trailing edge of the card K. However, these pressing rollers 32, 33 will not interfere with the respective edges of the card K because the rollers 32, 33 are lifted by the respective lifting wings 40, 41 at the time of riding over the respective edges of the card K. As a result, the card K is effectively prevented from positionally deviating.

Further, each stopper pin 27 projects above the surface member 26 every time the associated follower plunger 30 rides over the cam track member 31. However, since the projecting movement of the stopper pin 27 takes place only ahead of the printhead 5, the former will never interfere with the latter.

After finishing the color printing, the carrier table 7 is advanced fully to its advancing limit position by forwardly rotating the motor 43 (FIG. 1), and the lever 64 is pivoted slightly forward (with respect to the card transfer direction) by actuating an unillustrated solenoid, as shown in FIG. 10. In this position, each pusher pin 66 is caused to project above the surface member 26 because the associated follower plunger 69 interacts with the cam track member 31. As a result, the trailing edge of the card K is lifted up, whereas the hooked tip end 65*a* of the engaging member 65 is lowered for engagement with the trailing edge of the card K.

Figure 11:
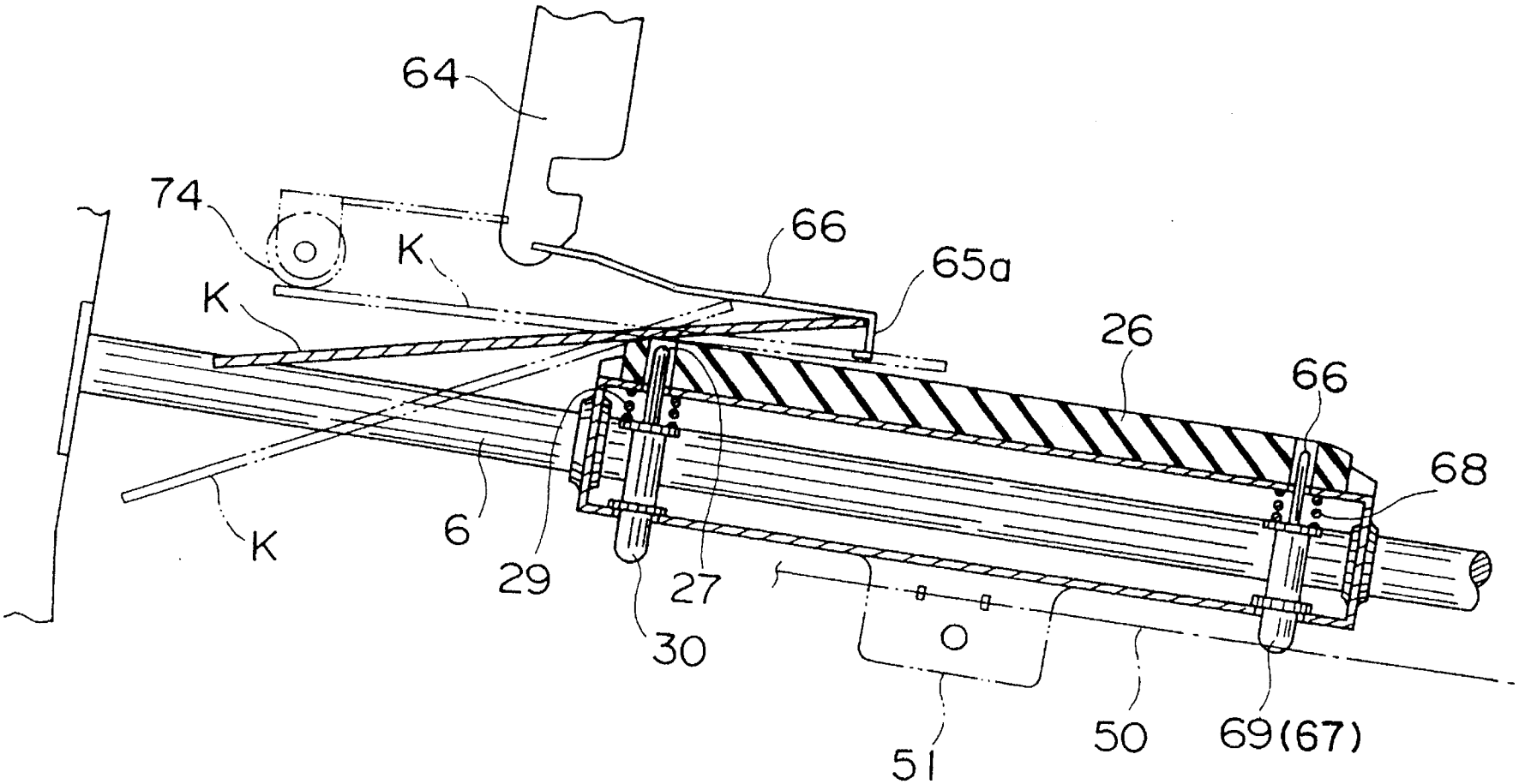

In the above condition, the carrier table 7 is moved backward, but the card K engaging the hooked tip end 65*a* of the engaging member 65 is prevented from moving backward with the table 7, as shown in FIG. 11. As a result, the card K falls off the table 7 toward the chute 70 (see FIG. 1) for taking out when the latter moves backward to a predetermined position. If desired, the lever 64 may be provided with a pressing roller 74 for downwardly pressing the leading edge of the card K.

In the meantime, the carrier table 7 returns to its standby position to perform the next printing cycle.

The preferred embodiment of the present invention being thus described, it is obvious that the same may be varied in many ways.

For instance, the card stocker 3 may be omitted, in which case each card are manually supplied to a support table (not shown) arranged in facing relation to the entry feed rollers 12. Further, the card transfer mechanism 4 may comprise feed belts (not shown) in place of the feed rollers 12, 13*a*, 13*b*, 14*a*, 14*b*. Moreover, the card printer 1 may be used not only for color printing but also for monochromic printing. Such variations are not to be regarded as a departure from the spirit and scope of the present invention, and all such various as would be obvious to those skilled in the art are intended to be included in the scope of the following claims.

We claim:

1. A card printer for impressing a print on cards that have a leading edge and a trailing edge, the card printer comprising:

a printhead;

a carrier table reciprocatively movable along a movement path in facing relation to the printhead;

a drive mechanism for reciprocating the carrier table;

a card transfer mechanism for successively feeding cards onto the carrier table; and positioning means for appropriately positioning said each card on the carrier table;

wherein the positioning means comprises stopper means which is movable with the carrier table and retractably projectable from the carrier table for stopping engagement with the leading edge of said each card, and a stationary cam mechanism engageable with the stopper means for causing the stopper means to project from the carrier table when the carrier table assumes a standby position for receiving said each card.

2. The card printer according to claim 1, wherein the stopper means comprises a pair of stopper pins.

3. The card printer according to claim 2, wherein the cam mechanism comprises a follower plunger connected to each of the stopper pins and spring means for biasing the follower plunger in a retracting direction, and a cam track member for camming contact with the follower plunger.

4. The card printer according to claim 1, wherein the positioning means further comprises front pressing roller means positioned ahead of the printhead for movement toward and away from the carrier table, rear pressing roller means positioned behind the printhead for movement toward and away from the carrier table but spaced from the front pressing roller means by a distance which is smaller than a length of a said card, and spring means for bringing each of the front and rear pressing roller means into pressing contact with said card.

5. The card printer according to claim 4, wherein the carrier table is provided with front lifting means for lifting the front pressing roller means away from the carrier table when the front pressing roller means rides over the leading edge of said card, the carrier table being further provided with rear lifting means for lifting the rear pressing roller means away from the carrier table when the rear pressing roller means rides over the trailing edge of said card.

6. The card printer according to claim 1, further comprising a card stocker for receiving a stack of cards, wherein the card transfer mechanism comprises returning means for returning, to the card stocker, an additional card that is erroneously fed with said each card while allowing said card to advance to the carrier table.

7. The card printer according to claim 1, further comprising a lifting mechanism for moving the printhead toward and away from the carrier table.

8. The card printer according to claim 1, further comprising a discharge mechanism for discharging said cards from the carrier table when the carrier table advances to a predetermined discharge position.

9. The card printer according to claim 8, wherein the discharge mechanism comprises a pivotal lever carrying an engaging member, the pivotal lever being pivotable between an operative position and a non-operative position, the engaging member having a hooked tip end for engagement with the trailing edge of said cards when the lever is pivoted to the operative position after the carrier table advances to the discharge position.

10. The card printer according to claim 9, wherein the discharge mechanism further comprises pusher means carried by the carrier table and cooperating with the cam mechanism for pushing up the trailing edge of said cards when the carrier table advances to the discharge position.

11. A card printer for impressing a print on cards that each have a leading edge and a trailing edge, the card printer comprising:

a printhead;

a carrier table reciprocatively movable along a movement path in facing relation to the printhead;

a drive mechanism for reciprocating the carrier table;

a card transfer mechanism for successively feeding each cards on the carrier table; and positioning means for appropriately positioning said each card on the carrier table;

wherein the positioning means comprises stopper means which is retractably projectable from the carrier table for stopping engagement with the leading edge of each card, and a cam mechanism for causing the stopper means to project from the carrier table when the carrier table assumes a standby position for receiving said each card;

wherein the stopper means comprises a pair of stopper pins; and wherein the cam mechanism comprises a follower plunger connected to each of the stopper pins and spring means biasing the follower plunger in a retracting direction, and a cam track member for camming contact with the follower plunger.

12. A card printer for impressing a print on cards that have a leading edge and a trailing edge, the card printer comprising:

a printhead;

a carrier table reciprocatively movable along a movement path in facing relation to the printhead;

a drive mechanism for reciprocating the carrier table;

a card transfer mechanism for successively feeding cards onto the carrier table; and positioning means for appropriately positioning said cards on the carrier table;

wherein the positioning means comprises front pressing roller means positioned ahead of the printhead for movement toward and away from the carrier table, rear pressing roller means positioned behind the printhead for movement toward and away from the carrier table but spaced from the front pressing roller means by a distance which is smaller than the length of said cards, and spring means for bringing each of the front and rear pressing roller means into pressing contact with said cards.

13. The card printer according to claim 12, wherein the carrier table is provided with front lifting means for lifting the front pressing roller means away from the carrier table when the front pressing roller means rides over the leading edge of said cards, the carrier table being further provided with rear lifting means for lifting the rear pressing roller means away from the carrier table when the rear pressing roller means rides over the trailing edge of said cards.

14. A card printer for impressing a print on cards that have a leading edge and a trailing edge, the card printer comprising:

a printhead;

a carrier table reciprocatively movable along a movement path in facing relation to the printhead;

a drive mechanism for reciprocating the carrier table;

a card transfer mechanism for successively feeding cards onto the carrier table;

positioning means for appropriately positioning said cards on the carrier table; and a card stocker for receiving a stack of cards, wherein the card transfer mechanism comprises returning means for returning, to the card stocker, an additional card that is erroneously fed with said card while allowing said card to advance to the carrier table.

15. A card printer for impressing a print on cards that have a leading edge and a trailing edge, the card printer comprising:

a printhead;

a carrier table reciprocatively movable along a movement path in facing relation to the printhead;

a drive mechanism for reciprocating the carrier table;

a card transfer mechanism for successively feeding said cards onto the carrier table;

positioning means for appropriately positioning said cards on the carrier table;

a discharge mechanism for discharging said cards from the carrier table when the carrier table advances to a predetermined discharge position; and wherein the discharge mechanism comprises a pivotal lever carrying an engaging member, the pivotal lever being pivotable between an operative position and a non-operative position, the engaging member having a hooked tip end for engagement with the trailing edge of said cards when the lever is pivoted to the operative position after the carrier table advances to the discharge position.

16. The card printer according to claim 15, wherein the discharge mechanism further comprises pusher means carried by the carrier table and cooperating with the cam mechanism for pushing up the trailing edge of said cards when the carrier table advances to the discharge position.

* * * * *